US006095963A

United States Patent [19]

Shaw

[11] Patent Number: 6,095,963

[45] Date of Patent: Aug. 1, 2000

[54] APPARATUS FOR MAKING CORRUGATED PAPERBOARD

[75] Inventor: Neil William Shaw, Sassafras, Australia

[73] Assignee: Amcor Limited, South Melbourne, Australia

[21] Appl. No.: 09/142,671

[22] PCT Filed: Mar. 12, 1997

[86] PCT No.: PCT/AU97/00151

§ 371 Date: Sep. 11, 1998

§ 102(e) Date: Sep. 11, 1998

[87] PCT Pub. No.: WO97/33746

PCT Pub. Date: Sep. 18, 1997

[30] Foreign Application Priority Data

Mar. 14, 1996 [AU] Australia ..... PN 8658

[51] Int. Cl.[7] ..... B31B 49/00; B31F 1/00

[52] U.S. Cl. ..... 493/379; 493/475; 493/478; 156/470; 156/472

[58] Field of Search ..... 156/473, 472, 156/471, 470, 210, 205; 493/84, 144, 374, 379, 384, 475, 478, 60

[56] References Cited

U.S. PATENT DOCUMENTS

| | | | |
|---|---|---|---|
| 1,184,748 | 5/1916 | Hicks | 156/472 |
| 1,796,541 | 3/1931 | Schoo | 156/471 |
| 3,541,829 | 11/1970 | Engleman | 72/196 |
| 4,818,330 | 4/1989 | Mosburger | 156/473 |
| 5,116,448 | 5/1992 | Murayama et al. | 156/472 |
| 5,306,384 | 4/1994 | Stutt | 156/473 |
| 5,674,349 | 10/1997 | McKinlay et al. | 156/172 |

FOREIGN PATENT DOCUMENTS

| | | |
|---|---|---|
| 11926/88 | of 0000 | Australia . |
| 25768/92 | of 0000 | Australia . |
| WO 90/04513 | 5/1990 | WIPO . |
| WO 93/10969 | 6/1993 | WIPO . |

*Primary Examiner*—Brian L. Johnson
*Assistant Examiner*—Matthew Luby
*Attorney, Agent, or Firm*—Alston & Bird LLP

[57] ABSTRACT

A paperboard corrugating machine for forming board having two corrugated mediums joined at their flute tips without any intervening liner. The machine comprises a relatively heavy main frame (11) and a second frame (12) which is mounted for movement on the main frame. The main frame (11) carries two rolls (13 and 14) and the second frame (12) carries two rolls (15 and 16). Frame (12) can be locked into position and loaded against the upper roll (13), and the four rolls (13, 14, 15 and 16) lie in a single plane when the rolls are operational. With this construction, movement and twisting of the rolls (13 and 15) relative to each other, between which the fluted mediums are aligned flute tip to flute tip, is reduced.

8 Claims, 1 Drawing Sheet

APPARATUS FOR MAKING CORRUGATED PAPERBOARD

This application is a continuation of PCT/AU97/00151 under 35 USC 371.

FIELD OF THE INVENTION

This invention relates to improvements in machinery for manufacturing corrugated paperboard of the type in which two corrugated mediums are joined at their flute tips without an intermediate flat sheet.

BACKGROUND OF THE INVENTION

Australian patents 609089 and 655076, which correspond to U.S. Pat. Nos. 4,886,563 and 5,674,349 respectively, disclose machinery for forming a corrugated paperboard structure having flute tip to flute tip bonding in which two sets of corrugating rolls are aligned so that two corrugated mediums are brought into tip to tip registration in the gap between the central two rolls and the combined mediums are then conveyed by an adjacent carrier roll to further downstream processing.

Patent 655076 identified that lack of rigidity in the support frame and in the corrugating rolls can lead to relative movement between the corrugating rolls and consequently to misalignment of the flute tips along the length of a roll, that is transversely of the paperboard. It attempted to alleviate the problem using end gears to control the relative position of the flute tips along the length of the two rolls. Misalignment of the flute tips in the finished board has a deleterious effect on the strength properties of the board.

BRIEF DESCRIPTION OF THE INVENTION

It is an object of this invention to provide an apparatus which reduces the likelihood of misalignment occurring.

To this end the present invention provides apparatus for making corrugated paperboard in which two fluted mediums are joined at the flute tips without an intermediate liner in which two pairs of corrugating rolls are arranged so that the fluted mediums are brought together at their flute tips between the inner rolls of each pair the improvement comprising the provision of one frame for all four rolls, with the second pair being on a second frame mounted on said one frame so that the second frame is moveable toward the inner roll of the first pair of corrugating rolls.

In more detail the invention provides apparatus for making corrugated paperboard in which two corrugated mediums are bonded together at their flute tips without any intermediate liner which apparatus includes a) a frame for mounting two pairs of corrugating rolls
b) a first corrugating roll fixedly mounted on said frame
c) a second corrugating roll mounted on said frame and capable of being pressed toward said first corrugating roll
d) a second frame mounted on said first frame on the side of said first corrugating roll remote from said second corrugating roll, said second frame being capable of being moved toward and away from said first corrugating roll
e) a third corrugating roll fixedly mounted on said second frame
f) a fourth corrugating roll mounted on said second frame on the side of said third roll remote from said first roll, said fourth roll being capable of being moved toward and away from said third roll
g) a locking mechanism for locking the second frame into position on the first frame so that a fixed gap is created between the first and third corrugating rolls.

This frame arrangement contrasts with the frame used in the machine described in patents 609089 and 655076. In those patents the frame was in two parts with the first and second rolls and the carrier roll on one frame, the third and fourth rolls on the second frame and the two frames being brought together to align the corrugations of the first and third rolls. This arrangement lacked rigidity particularly along the length of the aligned corrugations between the first and third rolls. The fact that the carrier roll was part of one frame made it cumbersome to move.

By having one frame for mounting all four corrugating rolls and mounting the second pair of rolls on a second frame to form a cassette that is mountable on the first frame, movement and twisting of the first and third corrugated rolls relative to each other is reduced.

It is preferred that the main frame be thicker than for conventional corrugating machines and a thickness of at least 200 mm is preferred.

BRIEF DESCRIPTION OF THE DRAWING

The drawing is a schematic representation of the invention showing the main rolls in their open or non operational positions.

DETAILED DESCRIPTION OF THE PREFERRED EMBODIMENT

Figure 1:
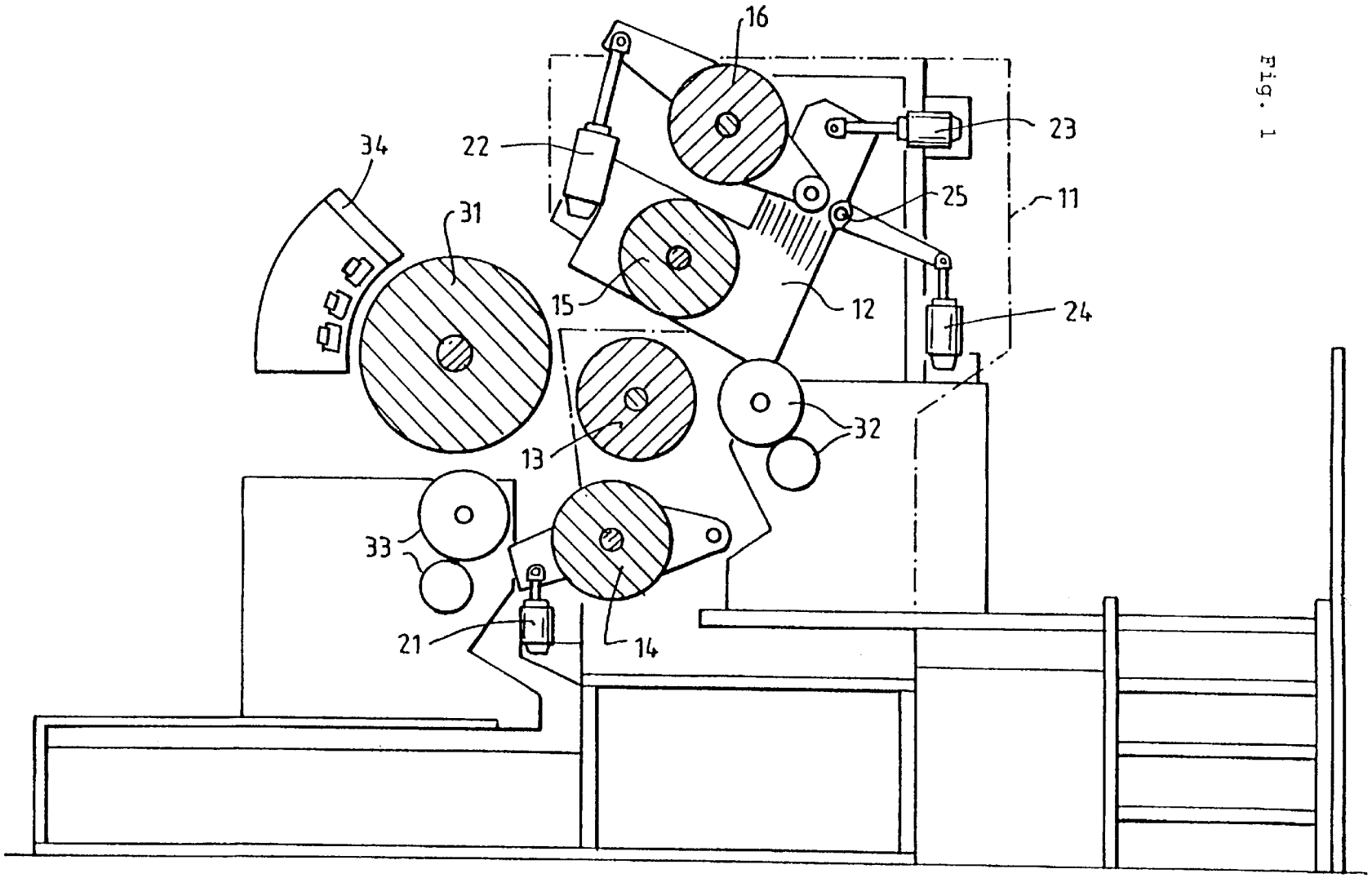

The method and general form of the corrugating machine is similar to that described in Australian patents 609089 and 655076.

The core of the apparatus is the arrangement of the two pairs of corrugating rolls. These are mounted on the main frame 11 shown in dotted outline. A second frame 12 is mounted on the frame 11. The frame 11 is made of plate steel of greater thickness than for conventional corrugators and the plates are spaced further apart than is conventional to enable the use of wider bearings and to increase the columnar stiffness of the frame. The frame 11 is preferably formed of two 45 mm plates spaced 240 mm apart. In the machine direction the frame is wider at the bottom than at the top.

The first pair of corrugating rolls are rolls 13 and 14. Roll 13 is fixed to the main frame 11 and is the reference from which the locations of the other rolls are determined. By fixing roll 13 in frame 11, twisting and other relative movement of roll 13 is restricted. Roll 14 is loaded against roll 13 by hydraulic rams schematically shown as 21.

Rolls 15 and 16 are mounted cassette fashion on the second frame 12. Roll 15 is fixed in position within frame 12. The frame 12 is made of solid steel 200 mm thick. Roll 16 is loaded against roll 15 by hydraulic pressure provided preferably by a pair of hydraulic rams, schematically represented by ram 22. The frame 12 is loaded against roll 13 by a pair of hydraulic rams schematically represented by ram 23. When this has been achieved frame 12 is locked into position by a pair of hydraulic rams as represented by 24 acting on a pair of over center toggle mechanisms schematically represented as toggle 25 to lock roll 15 into a fixed gap position relative to roll 13. When the frame 12 is locked into position on frame 11 the axes of the four rolls 13,14,15 and 16 lie in one plane. Preferably the four corrugating rolls are arranged in a vertical array.

The other elements of the apparatus as shown in the drawing are the carrier roll 31 the glue applicators 32 and 33 and the glue radiation curing station 34. Carrier roll 31 is mounted independently of the frame 11 as is glue applicator 33. The glue station 32 however is mounted on the frame 11. In operation one paper web is fed over roll 14, between rolls 13 and 14 where it is corrugated and then over roll 13 between rolls 13 and 15. The second medium is fed over roll 16, between rolls 16 and 15 where it is corrugated and then over roll 15 between rolls 15 and 13. Glue is applied to the corrugated web on roll 13 by applicator 32 so that the webs on rolls 13 and 15 contact at their flute tips as they pass through the gap between rolls 13 and 15. This gap between rolls 13 and 15 is adjustable to cater for changes in the thickness of the paper webs passing between the gap. The adjustment can be achieved using tapered linear wedges against which the cassette is loaded. In order to achieve a fixed gap between rolls 13 and 15 and also exert a uniform pressure across the paper sheets the corrugating rolls are crowned differently to conventional corrugating rolls. Rolls 14 and 16 are provided with positive cambers or crowns and rolls 13 and 15 are provided with negative crowns or cambers whereas conventional corrugating rolls are all positively crowned. When the system is loaded the gap between rolls 13 and 15 does in fact produce a roll profile that is positive on both rolls. When the paper sheets are fed into the gap between rolls 13 and 15 the crowns or profiles flatten out to provide the uniform cross machine loading pressure. After leaving the gap between rolls 13 and 15, the joined webs then pass over the carrier roll 31 past glue applicator 33 for a liner to be applied at a point [not shown] between applicator 33 and radiator 34. Exposure to infra red radiation at station 34 hastens curing of the glue to bond the mediums to each other and the liner to the outer medium on carrier roll 31.

Because of the increased transverse rigidity of the rolls 13 and 15 created by the frame 11 for roll 13 and by frame 12 set in frame 11 for roll 15 alignment of the flute tips transversely can be maintained at higher production speeds than with the machines disclosed in patents 609089 and 655076.

The claims defining the invention are set out as follows:

1. Apparatus for making corrugated paperboard in which two corrugated mediums are bonded together at their flute tips without any intermediate liner which apparatus includes (a) a first frame for mounting two pairs of corrugating rolls (b) a first corrugating roll fixedly mounted on said first frame (c) a second corrugating roll mounted on said first frame and being movable toward and away from said first corrugating roll (d) a second frame mounted on said first frame on a side of said first corrugating roll remote from said second corrugating roll, said second frame being movable toward and away from said first corrugating roll (e) a third corrugating roll fixedly mounted on said second frame (f) a fourth corrugating roll mounted on said second frame on a side of said third roll remote from said first roll, said fourth roll being movable toward and away from said third roll (g) a locking mechanism for locking the second frame on the first frame so that a fixed gap is created between the first and third corrugating rolls (h) the mounting of the second frame on said first frame reducing twisting and movement of said first and third rolls relative to each other.

2. Apparatus as claimed in claim 1 wherein an over center toggle mechanism is used as the locking mechanism.

3. Apparatus as claimed in claim 1 wherein the first frame is wider in the machine direction at its base than at its top.

4. Apparatus as claimed in claim 1 wherein when operational the four corrugating rolls define respective axes which lie in a single plane.

5. Apparatus as claimed in claim 1 wherein the first and third corrugating rolls are negatively crowned.

6. Apparatus as claimed in claim 5 wherein the inner roll of the first pair is fixedly mounted on the said one frame and the inner roll of the second pair is fixedly mounted on said second frame.

7. Apparatus as claimed in claim 6 wherein the two inner rolls are negatively crowned.

8. Apparatus, for making corrugated paperboard in which two fluted mediums are joined at the flute tips without an intermediate liner, in which first and second pairs of corrugating rolls are arranged in line so that one roll from each pair form two inner rolls in the line of four and said fluted mediums are brought together at their flute tips between said inner rolls, the improvement comprising the provision of one frame for all four rolls, with the second pair being on a second frame mounted on said one frame so that the second frame is moveable toward the inner roll of the first pair of corrugating rolls.

* * * * *